US007033169B2

(12) United States Patent
Furney

(10) Patent No.: US 7,033,169 B2
(45) Date of Patent: Apr. 25, 2006

(54) VARIABLE TOOL

(75) Inventor: Anthony James Furney, Mudgee (AU)

(73) Assignee: Mark L. Anderson, Spring Valley, WI (US)

( * ) Notice: Subject to any disclaimer, the term of this patent is extended or adjusted under 35 U.S.C. 154(b) by 146 days.

(21) Appl. No.: 10/376,212

(22) Filed: Feb. 25, 2003

(65) Prior Publication Data

US 2004/0166455 A1 Aug. 26, 2004

(51) Int. Cl.
*A61D 5/00* (2006.01)

(52) U.S. Cl. ..... 433/1; 433/116

(58) Field of Classification Search ..... 433/1, 433/165, 116, 125, 130, 134
See application file for complete search history.

(56) References Cited

U.S. PATENT DOCUMENTS

| | | | | | |
|---|---|---|---|---|---|
| 670,086 | A | * | 3/1901 | Stanbrough | 433/1 |
| 854,955 | A | * | 5/1907 | Martin | 433/1 |
| 1,480,730 | A | * | 1/1924 | Lentz | 433/75 |
| 2,442,033 | A | * | 5/1948 | Brantly et al. | 433/82 |
| 3,811,693 | A | * | 5/1974 | Derbyshire | 279/18 |
| 4,021,920 | A | * | 5/1977 | Kirschner et al. | 433/82 |
| 4,722,685 | A | * | 2/1988 | de Estrada | 433/1 |
| 5,071,295 | A | * | 12/1991 | Greig | 279/156 |
| 6,273,712 | B1 | * | 8/2001 | Rach et al. | 433/1 |

FOREIGN PATENT DOCUMENTS

| | | |
|---|---|---|
| CH | 252232 | 12/1954 |
| DE | 19808450 A1 | 9/1999 |
| FR | 1052653 | 1/1954 |
| FR | 2775585 | 9/1999 |
| FR | 2816860 A1 | 5/2002 |
| GB | 838501 | 6/1960 |
| JP | 9075379 A | 3/1997 |

* cited by examiner

*Primary Examiner*—Ralph A. Lewis
(74) *Attorney, Agent, or Firm*—Skinner and Associates

(57) ABSTRACT

A variable tool (1) for use in veterinary procedures is provided. The tool (1) includes a handle (5) having first and second ends (7, 8), the first end (7) engageable with a drive means. A shaft (10) having first and second ends (12, 13), the first end (12) of the shaft (10) being mounted within the handle (5) and, in use, rotatable by the drive means. A housing (15) is secured to the second end (8) of the handle (5) and having a free end (27) extending towards the second end (13) of the shaft (10). A burr portion (20) is relaesably engageable with and extending away from the second end (13) of the shaft (10). A connection means (35) is adapted to releasably connect the burr portion (20) to the second end (13) of the shaft (10) such that the burr portion (20) is removable from the shaft (10) without removal of the housing (15) from the handle (5).

21 Claims, 7 Drawing Sheets

VARIABLE TOOL

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND

1. Field

The present invention relates to variable tools and in particular to a variable tool for use in veterinarian procedures such as equine dentistry and animal husbandry.

2. Background Information

Variable tools such as Dremel and Suhner tools are well-known hand held devices used for a range of cutting or grinding operations.

In the field of equine dentistry, for example, Dremel grinders generally include a Dremel hand piece attached to a housing having an elongate shaft located therein. The shaft having a burr formed at the distal end. A large range of corresponding housings and shafts of varying lengths are provided for different equine operations.

With these existing equine tools if the shaft, (which has the burr formed at the distal end) is damaged or broken, the entire tool need to be dismantled to replace the shaft. The dismantling of the tool and the replacement of the shaft is complicated and time consuming. Replacement shafts are also very expensive.

Accordingly, there is a need for an inexpensive, quickly interchangeable burr and shaft assembly.

OBJECT OF THE INVENTION

It is an object of the present invention to overcome or ameliorate some of the disadvantages of the prior art, or at least to provide a useful alternative.

BRIEF SUMMARY

There is a disclosed herein a variable tool for use in veterinary procedures; said tool including:

a handle having first and second ends, said first end engageable with a drive means;

a shaft having first and second ends, said first end of said shaft being mounted within said handle and, in use, rotatable by said drive means;

a housing secured to said second end of said handle and having a free end extending towards said second end of said shaft;

a burr portion releasably engageable with and extending away from said second end of said shaft, and a connection means adapted to releasably connect said burr portion to said second end of said shaft such that said burr portion is removable from said shaft without removal of the housing from said handle.

Preferably, said connection means includes mating complimentary engagement formations on said burr portion and said second end of said shaft for engagement therebetween.

Preferably, wherein said mating complimentary engagement formations include male and female threads respectively.

Preferably, wherein said mating complimentary engagement formations include a bore and a spigot respectively.

Preferably, wherein aid connection means includes a locking assembly to lock together said mating complimentary engagement formations.

Preferably, wherein said locking assembly utilizes a grub screw.

Preferably, wherein said locking assembly is accessible without removal of the housing from said handle.

Preferably, wherein said housing includes a hole for gaining access to said locking assembly.

Preferably, wherein said connection means includes a joining member having a bore at one end for connection with said burr portion and a bore at the other end for connection with said second end of said shaft.

Preferably, wherein said bores are a common bore.

Preferably, wherein said joining member includes a locking assembly to lock together said burr portion and said second end of said shaft to said joining member.

Preferably, wherein said locking assembly utilizes a grub screw.

Preferably, wherein said locking assembly is accessible without removal of the housing from said handle.

Preferably, wherein said housing includes a hold for gaining access to said locking assembly.

Preferably, wherein said tool includes a guard portion attachable to said free end of said housing and having an opening.

Preferably, wherein said burr portion is adapted to at least partially protrude through said guard portion opening.

Preferably, wherein said connection means is adapted to at least partially protrude through said guard portion opening.

Preferably, wherein said guard portion is screwable to said housing.

Preferably, wherein said burr portion includes a shank termination in a head having a cylindrical or round burr thereon.

Preferably, said burr is solid carbide or diamond coated.

Preferably, said tool includes water cooling means.

Preferably, said tool includes vacuum means.

Preferably, said tool is sterilizable.

BRIEF DESCRIPTION OF THE SEVERAL VIEWS OF THE DRAWING

A preferred from of the present invention will now be described, by way of example only, with reference to the accompanying drawings wherein.

DETAILED DESCRIPTION

Figure 1:
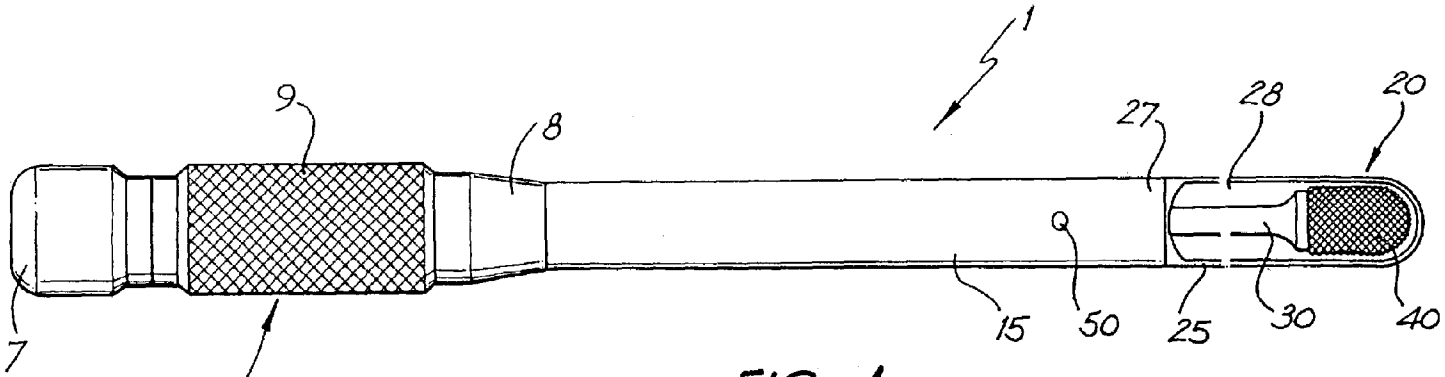
FIG. 1 is a plan view of a variable tool in accordance with a first embodiment of the invention.
Figure 2A:
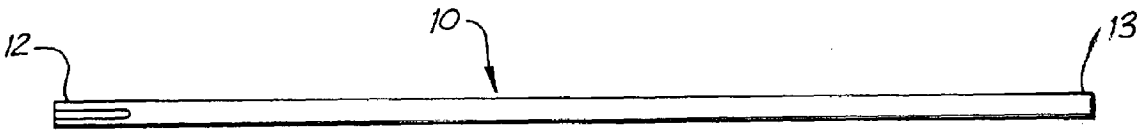
FIGS. 2A to 2D are parts exploded views of the handle, shaft and housing shown in FIG. 1.
Figure 2B:
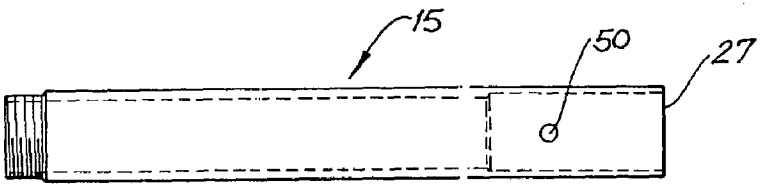
Figure 2D:
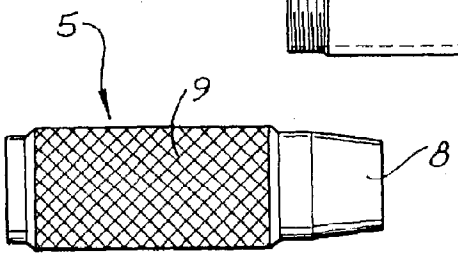
Figure 2C:
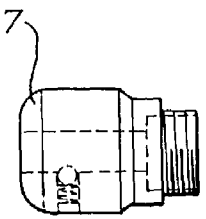
Figure 3A:
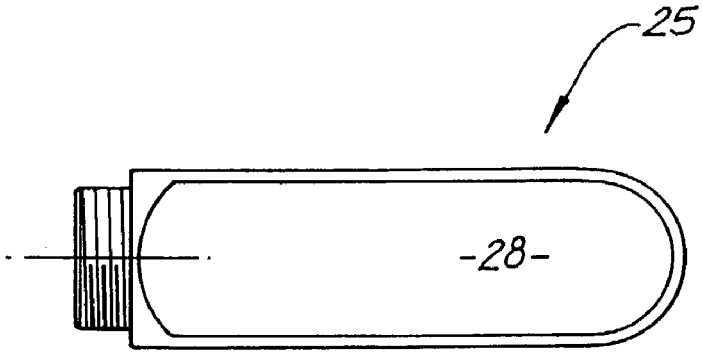
FIGS. 3A and 3B are parts exploded views of the guard and burr shown in FIG. 1.
Figure 3B:
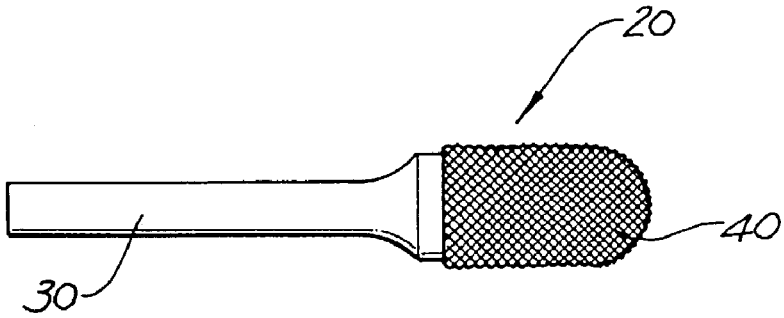
Figure 7:
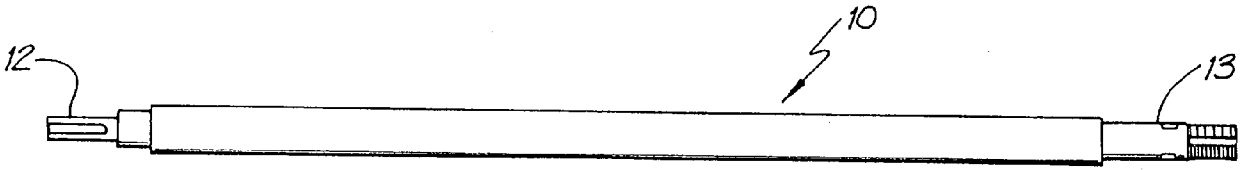
FIG. 7 is a parts exploded view of an alternate shaft.

In the accompanying drawings, there is schematically depicted a variable tool 1 for use in veterinary procedures such as equine dentistry. The tool 1 includes a handle 5 having first and second ends 7 and 8 and a grip 9. The first and second ends 7 and 8 can be integrally formed or of several interchangeable parts (as in FIGS. 2C and 2D). The first end 7 is engageable with a drive means (not shown) such as a Dremel motor. A shaft 10 has first and second ends 12 and 13, the first end 12 being mounted within the handle 5 and, in use, rotatable by the drive means of the motor. A housing 15 is secured on the second end 8 of the handle 5, preferably by a screw thread, and has a free end 27 extending towards the second end 13 of the shaft 10. The end 13 could also include a threaded end, such as in FIG. 7, to receive a collett type assembly, for example. The housing 15 could also be secured directly to the first end 7 of the handle 5.

An interchangeable burr portion 20 is releasably engaged with and extends away from the second end 13 of the shaft 10, such that the burr portion 20 is easily replaceable, as will be explained below. A connection means 35 (see for example, FIG. 4 and discussed further below) is adapted to releaseably connect the burr portion 20 to the second end 13 of the shaft 10 such that the burr portion 20 is removable from the shaft 10 without removal of the housing 15 from the handle 5. A guard portion 25 is mounted on the free end 27 of the housing 15 preferably by way of a screw thread and has an opening 28.

Figure 4:
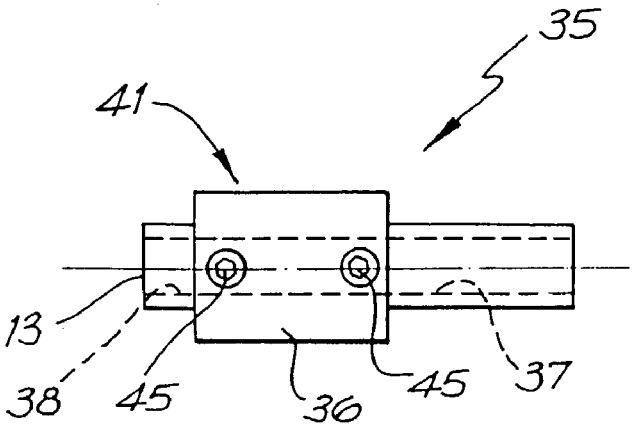
FIG. 4 is a partial view of a first embodiment of the connection means for the shaft and burr.
Figure 8B:
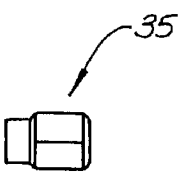
FIGS. 8A and 8B are alternate connection means between the shaft and burr of FIG. 10.
Figure 8A:
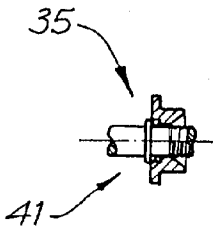
Figure 9:
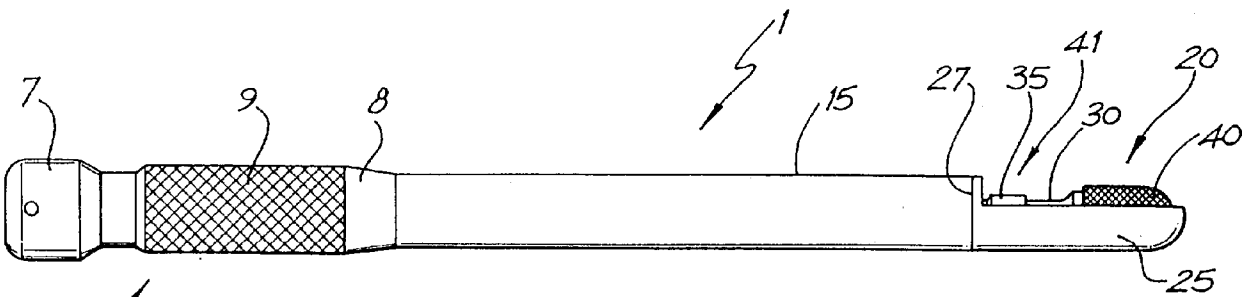
FIG. 9 is a plan view of a variable tool in accordance with an alternate embodiment of the invention.
Figure 10A:
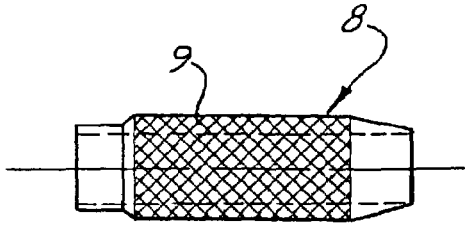
FIGS. 10A to 10C are parts exploded views of the alternate handle and housing of FIG. 10.
Figure 10B:
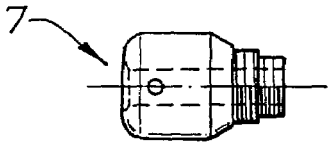
Figure 10C:
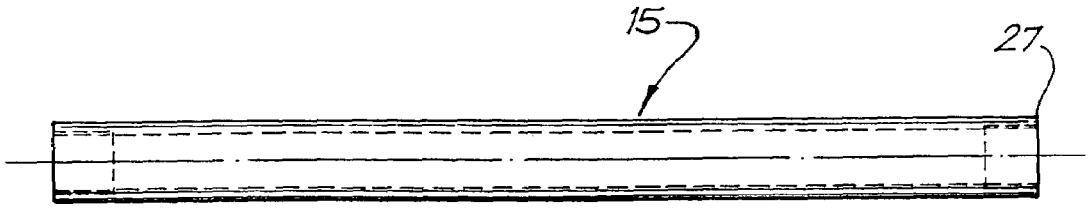
Figure 10D:
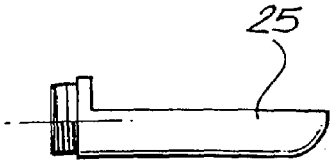
FIG. 10D is a side view of an alternate guard of FIG. 9.
Figure 10E:
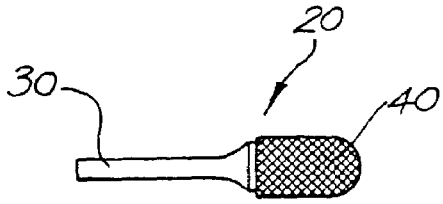
FIG. 10E is a side view of an alternate burr of FIG. 9.
Figure 11A:
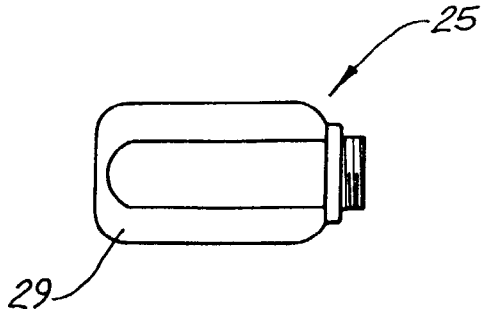
FIGS. 11A to 11C are front, side and end views of an alternate guard.
Figure 11B:
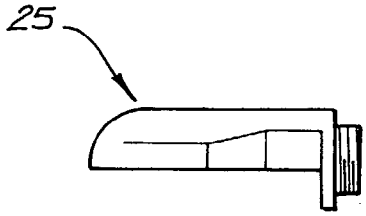
Figure 11C:
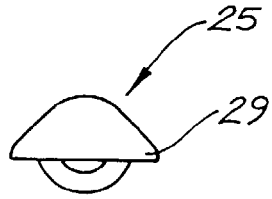
Figure 12:
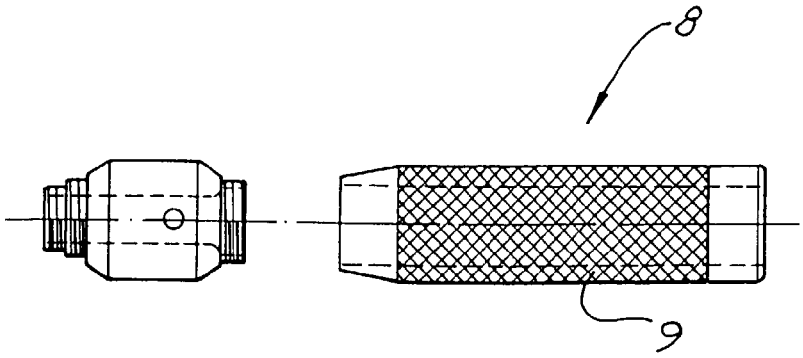
FIG. 12 is an alternate handle.

The connection means 35 could be of any arrangement, however, in FIG. 4 it is shown as an arrangement of a joining member 36 having bore 37 at one end for connection with the burr portion 20 and a bore 38 at the other end for connection with the second end 13 of the shaft 10. In FIG. 4, the bores 37, 38 are common bores. The joining member 36 includes a locking assembly 41 to lock together the burr portion 20 and the second end 13 of the shaft 10 to the joining member 36. In FIG. 4, the locking assembly 41 is shown as two grub screws 45 which upon application of a key such as an allen key secure the burr portion 20 and second end 13 of the shaft 10. This arrangement should be independent of the housing 15 to allow the shaft 10 and burr portion 20 to rotate freely within the housing 15. The grub screws 45 can be accessed through one or more holes 50 in the housing 15 or by removing the guard portion 25. An alternate embodiment of the connection means 35 is shown in FIGS. 8A and 8B where a collett type assembly is utilized. This can include a nut, threaded surfaces and seals and allows an open ended spanner to be used. The connection means 35 in that embodiment is freely accessible to a user through the opening 28 in the guard portion 25.

Referring to FIGS. 3B, 4, 8A, and 10E, the burr portion 20 includes a shank 30 connected to the second end 13 of the shaft 10 by way of connection means 35 and terminates at a head 40 having a cylindrical or round burr thereon. The cylindrical or round burr is preferably solid carbide or diamond coated, however, could be of any typical burr type. A diamond-coated burr is preferable as it provides less vibration, longer tool life, and are easier to handle during operation.

Figure 5A:
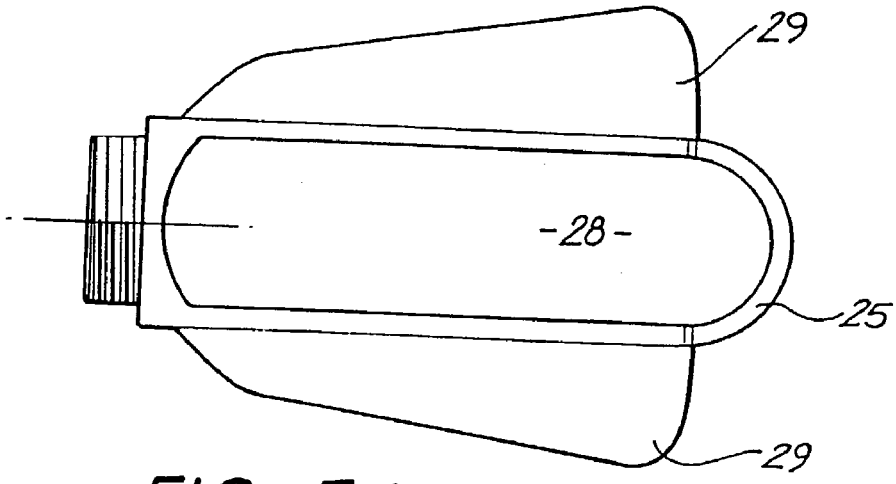
FIGS. 5A to 5C are front, side and end views of an alternate guard.
Figure 5B:
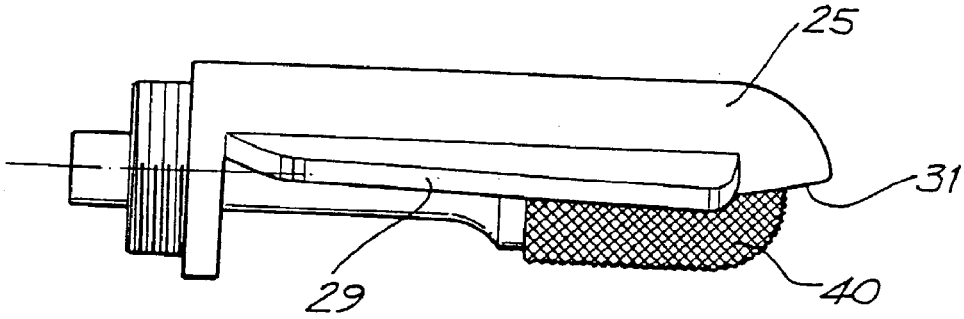
Figure 5C:
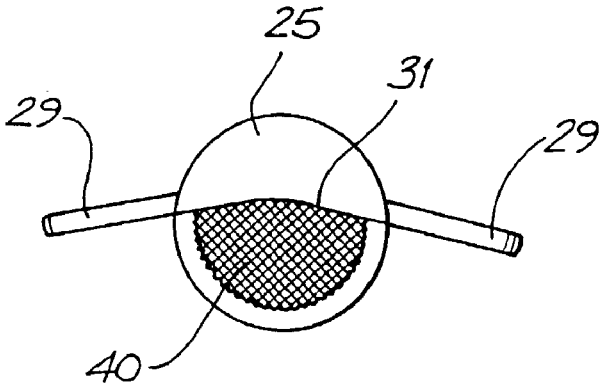
Figure 6A:
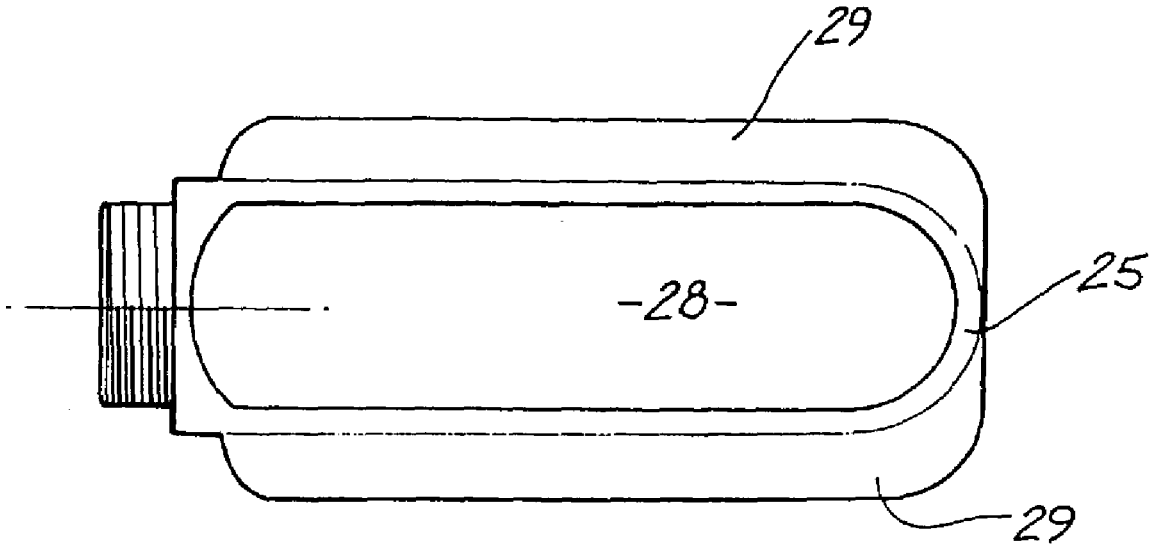
FIGS. 6A and 6B are front and end views of a further alternate guard.
Figure 6B:
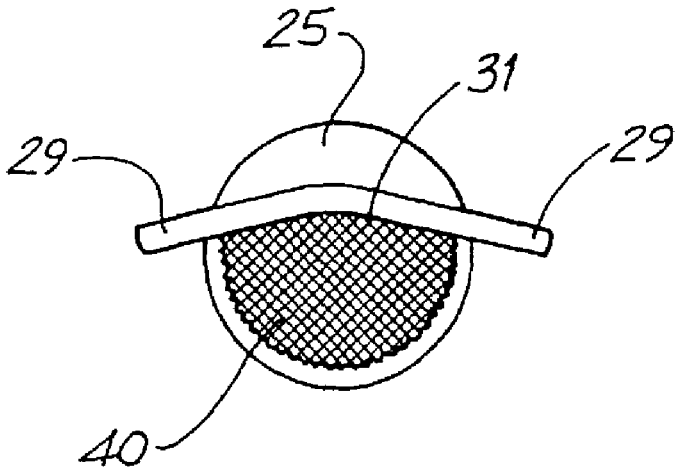

As shown in FIGS. 5A to 5C, 6A and 6B and 11A to 11C, the guard portion 25 can include wings 29 angled towards the burr portion 20 and providing further shielding from the burr portion 20 in use. Further, the guard portion 25 can include a cambered end 31 as shown in FIGS. 5A to 5C. Alternate arrangements of the wing 29 could also be used.

The tool 1 could include further attachments such as water cooling means (not shown) or vacuum means (not shown) either externally or integrally of the tool 1 and be completely sterilizable. The handle 5 could include an integrally formed four bearing hand piece to allow better balance. It could also include a pistol grip arrangement and/or an adjustable handle. Preferably, the entire construction is stainless steel.

In use, the user easily replaces the burr portion 20 by simply unlocking the connection means 35 by, for example, unscrewing the grub screws 45 through hole 50 in the housing 15 by use of an allen key (FIG. 4). This will loosen the connection between the shank 30 and the burr portion 20 and the second end 13 of the shaft 10. The guard 25 is unscrewed to remove the burr portion 20 from the shank 10 with housing 15 remaining in place. This arrangement allows for very quick and easy replacement of the burr portion 20. Further, as the burr portion 20 is preferably a stand 2-inch burr, the cost of the replacement is minimal and as the burr portion 20 would be a proprietary item, a replacement burr can easily be obtained.

Although the invention has been described with reference to specific example, it will be appreciated by those skilled in the art that the invention may be embodied in many other forms.

What is claimed is:

1. A variable tool for use in veterinary procedures; said tool including:

a handle having first and second ends, said first end engageable with a drive means;

a shaft having first and second ends, said first end of said shaft being mounted within said handle and, in use, rotatable by said drive means;

a housing secured to said second end of said handle and having a free end extending towards said second end of said shaft;

a burr portion releasably engageable with and extending away from said second end of said shaft;

a connection means disposed within the housing and adapted to quickly and releaseably connect said burr portion coaxially to said second end of said shaft such that said burr portion is removable from said shaft without removal of the housing from said handle;

wherein said connection means includes mating complimentary engagement formations on said burr portion and said second end of said shaft for engagement therebetween; and wherein said connection means includes a locking assembly to lock together said mating complimentary engagement formations.

2. The tool according to claim 1, wherein said mating complimentary engagement formations include male and female threads respectively.

3. The tool according to claim 1, wherein said mating complimentary engagement formations include a bore and a spigot respectively.

4. The tool according to claim 1, wherein said locking assembly utilizes a grub screw.

5. The tool according to claim 1, wherein said locking assembly is accessible without removal of the housing from said handle.

6. The tool according to claim 1, wherein said housing includes a hole for gaining access to said locking assembly.

7. The tool according to claim 1, wherein said mating complimentary engagement formations are collett type surfaces.

8. The tool according to claim 1, wherein said connection means includes a joining member having a bore at one end for connection with said burr portion and a bore at the other end for connection with said second end of said shaft.

9. The tool according to claim 8, wherein said bores are a common bore.

10. The tool according to claim 8, wherein said joining member includes a locking assembly to lock together said burr portion and said second end of said shaft to said joining member.

11. The tool according to claim 10, wherein said locking assembly utilizes a grub screw.

12. The tool according to claim 10, wherein said locking assembly is accessible without removal of the housing from said handle.

13. The tool according to claim 10, wherein said housing includes a hole for gaining access to said locking assembly.

14. The tool according to claim 1, wherein said tool includes a guard portion attachable to said free end of said housing and having an opening.

15. The tool according to claim 14, wherein said burr portion is adapted to at least partially protrude through said guard portion opening.

16. The tool according to claim 14, wherein said connection means in adapted to at least partially protrude through said guard portion opening.

17. The tool according to claim 14, wherein said guard portion is screwable to said housing.

18. The tool according to claim 1, wherein said burr portion includes a shank terminating in a head having a cylindrical or round burr thereon.

19. The tool according to claim 18, wherein said burr is solid carbide or diamond coated.

20. The tool according to claim 1, wherein said tool is sterilisable.

21. A variable tool for use in veterinary procedures; said tool including:

a handle having first and second ends, said first end engageable with a drive means;

a shaft having first and second ends, said first end of said shaft being mounted within said handle and, in use, rotatable by said drive means;

a housing secured to said second end of said handle and having a free end extending towards said second end of said shaft;

a burr portion releasably engageable with and extending away from said second end of said shaft;

a connection means disposed within the housing and adapted to quickly and releaseably connect said burr portion coaxially to said second end of said shaft such that said burr portion is removable from said shaft without removal of the housing from said handle;

wherein said connection means includes a joining member having a bore at one end for connection with said burr portion and a bore at the other end for connection with said second end of said shaft; and wherein said joining member includes a locking assembly to lock together said burr portion and said second end of said shaft to said joining member.

* * * * *